United States Patent [19]

Sasaki

[11] 4,078,506

[45] Mar. 14, 1978

[54] ELECTRIC SEWING MACHINE

[75] Inventor: Tosio Sasaki, Nagoya, Japan

[73] Assignee: Brother Kogyo Kabushiki Kaisha, Nagoya, Japan

[21] Appl. No.: 670,844

[22] Filed: Mar. 26, 1976

[30] Foreign Application Priority Data

Mar. 28, 1975 Japan ..... 50-36636

[51] Int. Cl.[2] ..... D05B 3/02

[52] U.S. Cl. ..... 112/158 R; 112/277

[58] Field of Search ..... 112/158 R, 158 E, 210, 112/203, 220, 158 B, 158 C, 274, 277

[56] References Cited

U.S. PATENT DOCUMENTS

| | | | |
|---|---|---|---|
| 2,929,344 | 3/1960 | Theenhausen et al. | 112/158 E |
| 3,037,471 | 6/1962 | Reeber et al. | 112/158 R |
| 3,077,845 | 2/1963 | Bono | 112/274 |
| 3,108,555 | 10/1963 | Engel | 112/210 X |
| 3,217,679 | 11/1965 | Novak | 112/277 |
| 3,319,591 | 5/1967 | Hamlett | 112/220 |
| 3,401,659 | 9/1968 | Kasuga | 112/158 R |
| 3,687,097 | 8/1972 | Kosrow et al. | 112/210 |

*Primary Examiner*—Werner H. Schroeder
*Assistant Examiner*—Peter Nerbun
*Attorney, Agent, or Firm*—Browdy and Neimark

[57] ABSTRACT

An electric sewing machine is provided on which it is feasible conveniently to perform variously programmed sewing, for example, continuous sewing for forming a desired zigzag seam and non-ravel seams at the start and the end of the zigzag seam. The sewing machine comprises:

- at least one regulator for influencing the operation of stitch forming instrumentalities thereof, i.e., an amplitude regulator and/or a feed regulator;
- a manual knob operatively connected to the regulator for setting the regulator at a desired setting;
- a single manually operable member shiftable among three specific positions,
- a first one for stopping the machine,
- a second one for running the machine under the operation of the knob to form the desired (e.g., zigzag) seam, and
- a third one for running the machine out of the operation of the knob to form a predetermined (e.g., non-ravel) seam.

15 Claims, 13 Drawing Figures

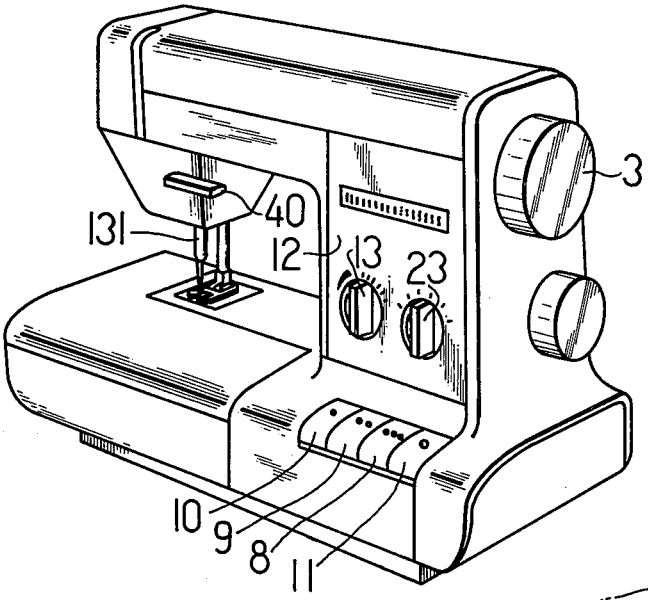
FIG. 1
FIG. 3
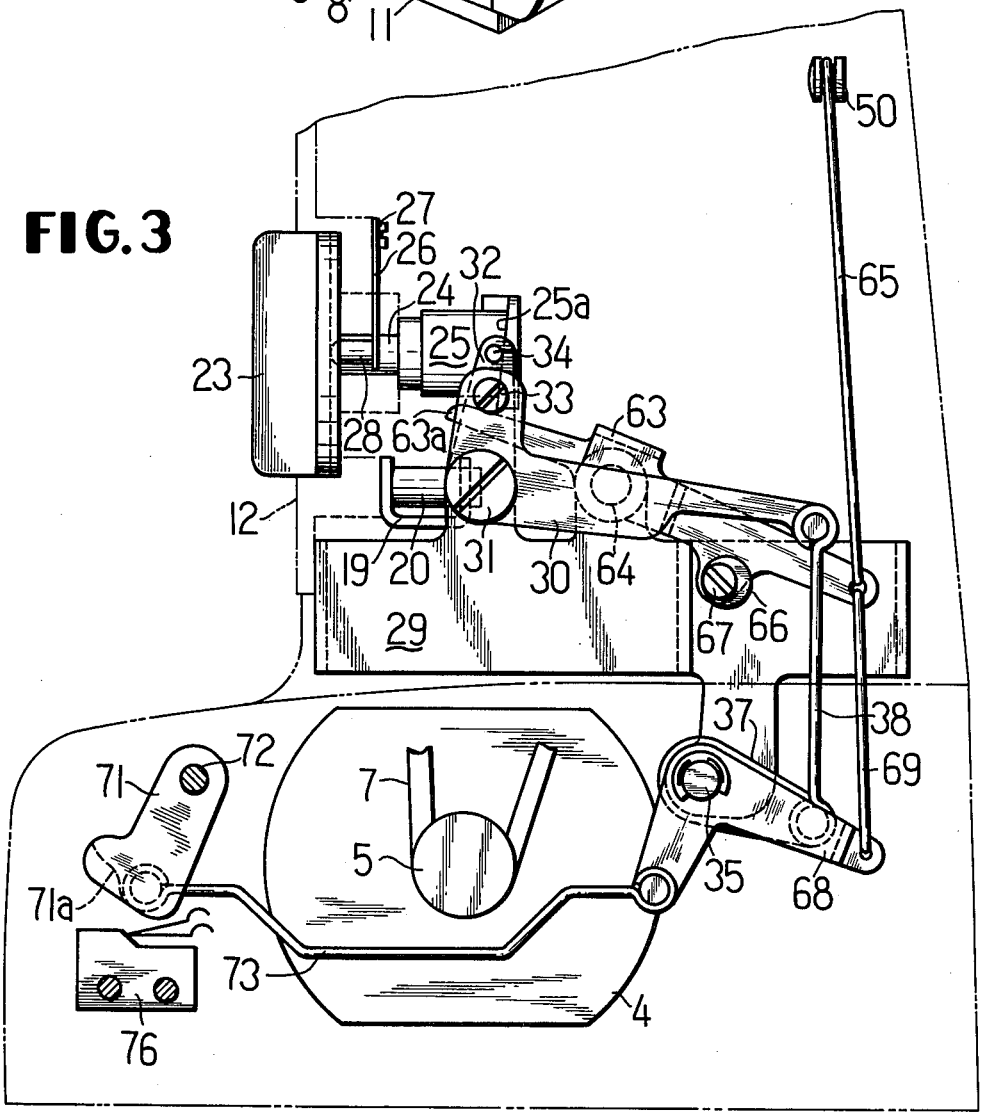

ELECTRIC SEWING MACHINE

BACKGROUND OF THE INVENTION

The present invention relates to an electric sewing machine comprising at least one regulator for influencing the operation of the stitch-forming instrumentalities, a manual knob operatively connected to the regulator for setting the same to a desired setting, and a single manually operable member for controlling the running and stopping of the machine through an electric circuit for controlling an electric motor.

A sewing machine is already known wherein an amplitude regulator or a feed regulator is set by the operation of a single manual knob to form a desired continuous seam, and a single manually operable member controls, by a shifting operation thereof from outside of the machine, driving of an electric motor through an electric circuit to run or stop the machine. In actual operation of such a machine, however, the operator feels frequently cumbersome in setting the regulator(s) and/or in controlling the machine, for instance, in the case of executing the sewing operation to form a continuous seam including a zigzag seam with a desired amplitude and a desired feed length and/or direction and a non-ravel seam or seams added to the zigzag seam at the beginning and/or end thereof, because the operation has to carry out the setting for non-ravel seaming both on the amplitude regulator and the feed one as well as the operation for running and stopping of the machine, respectively, but without neglecting their mutual delicate relation.

Furthermore, the operator has to, as usual, guide the work fabrics to be sewed along a predetermined seam-forming line during the operation. These operations are so cumbersome even for skilled operators to be a cause to neglect the essential non-ravel seaming.

SUMMARY OF THE INVENTION

The present invention has been completed, taking such a situation into consideration, to eliminate the above-mentioned drawbacks accompanied by conventional sewing machines.

Particularly, it is an object of the present invention to provide an improved electric sewing machine which is constructed in such a way that a manually operable member is shiftable to any one of three positions. A first position is to stop the machine. At a second position the sewing machine is to be run under the desired setting of at least one of regulators for amplitude and feed, etc., by a manual knob which is operatively connected to such regulator, resulting in forming a desired seam. At the third position, the sewing machine is to be run, under a predetermined condition of the at least one regulator, independently of and without interference with the manual knob, resulting in forming a predetermined seam, e.g., non-ravel seam.

With a machine according to the present invention it is feasible to control the running and stopping of the machine, as well as the change of seam, with a close relationship therebetween, by the optional operation of the single manually operable member, and therefore, it is a primary object of the present invention to provide a sewing machine which is easy to use and convenient to manipulate even for unskilled operators.

In a preferred embodiment of the present invention, it is also feasible to provide an electric sewing machine further comprising speed setting means having different operative conditions, such means being connected to an electric circuit for driving an electric motor, and manual means for setting the speed of the motor by selecting the operative condition of the speed setting means, which machine is run at a speed of the motor set by the manual means when the manually operable member is shifted to the second position, and is to be run at a predetermined speed of the motor independently of and without interference with the manual means when the manually operable member is shifted to the third position.

Therefore, another object of the present invention is to provide an electric sewing machine being subject to drive controls versatile in operation.

Furthermore, in a preferred embodiment, the sewing machine is provided with a programming means to control the shifting of the manually operable member sequentially in certain orders, and such shifting can be conducted as follows;

(a) from the first position through the second to the third, (b) from the third position automatically back to the second by spring means when the manually operable member is released at the third position and staying at the second position shifted, (c) from the second position again to the third position against the action of such spring means and automatically back to the first position passing the second.

Therefore, still another object of the present invention is to provide an electric sewing machine on which it is feasible to perform with extreme ease non-ravel seaming at the start and/or the end of a desired continuous seam.

Furthermore, in a preferred embodiment, the machine is constructed for the operator easily to render such programming means inoperative by the operator's intention, such that said non-ravel seaming can be omitted at will and therefore, a still further object of the invention is to provide an electric sewing machine which has versatile workability and is of practical use.

DESCRIPTION OF THE DRAWINGS

FIGS. 1 through 11 represent the first embodiment of the present invention wherein:

FIG. 1 is a perspective view showing the exterior appearance of the electric sewing machine;

FIG. 2 is a front elevational view of the machine's essential parts, with the machine frame removed;

FIG. 3 is a side elevational view taken along the line III — III of FIG. 2;

FIG. 4 is a fragmentary enlarged elevational view for illustrating the mechanism of position setting of the manually operable lever;

FIG. 5 is a plan view of FIG. 4;

FIG. 6 is likewise a projecting view of the same seen from the right side;

FIG. 7 is a chart of an electric circuit employed in the embodiment;

FIGS. 8 to 11 are all elevational views similar to FIG. 4 for respectively illustrating the different operative condition;

DETAILED DESCRIPTION OF THE INVENTION

Figure 2:
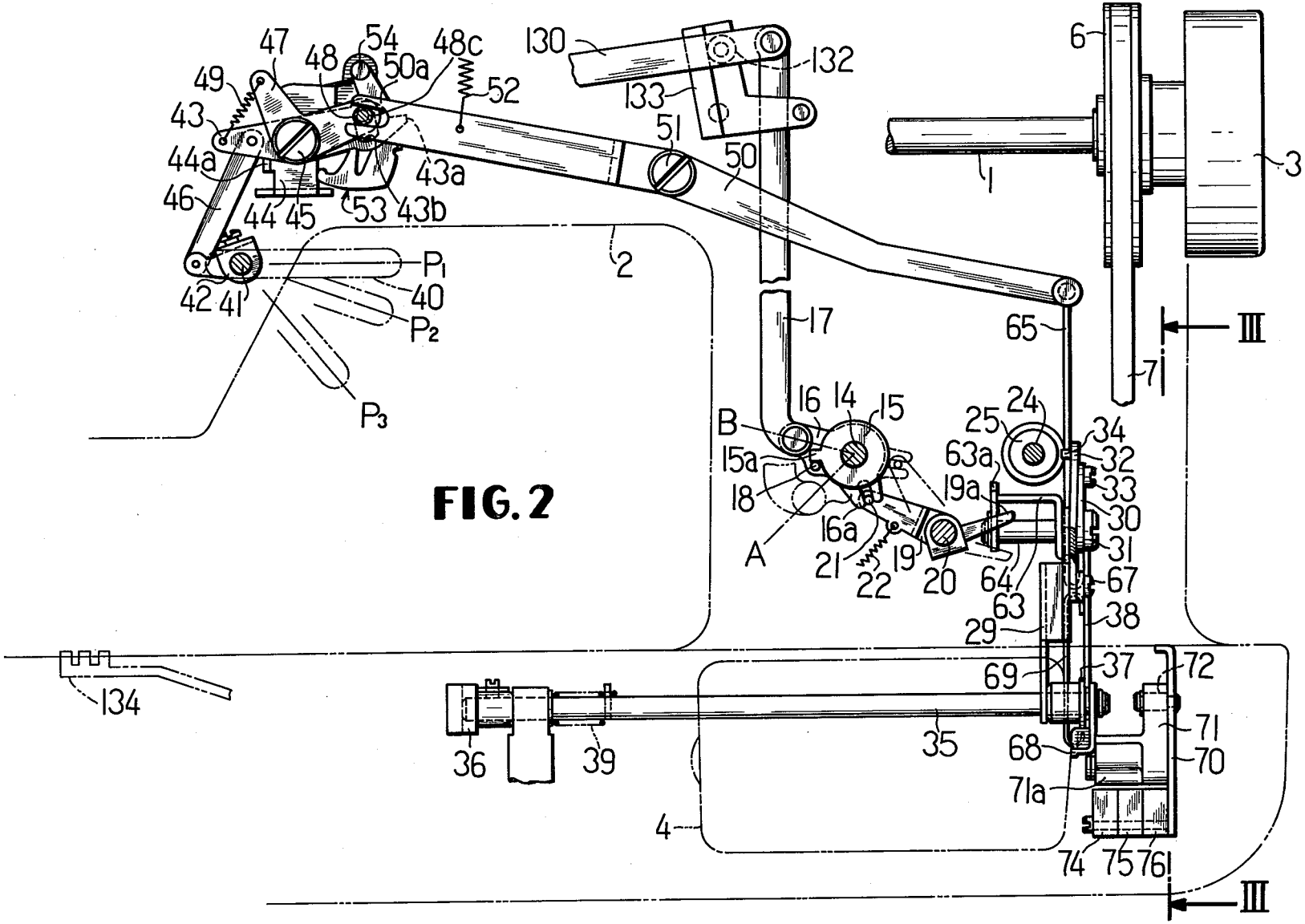

A main shaft 1 of the sewing machine (hereinafter simply referred to as machine in this description) is carried by the machine frame 2; on the outer end of the main shaft 1 is secured a handwheel 3. An electric motor 4 drives the main shaft 1 through a belt 7 entrained between a motor pulley 5 and a driven pulley 6 fixed on the main shaft 1. Speed-setting push buttons 8, 9 and 10 for selectively setting a rotating speed of motor 4 are arranged side by side, together with a releasing push button 11, in the front portion of the machine standard. On an auxiliary plate 12 secured to the front portion of the machine standard is rotatably carried a shaft 14, on which shaft a first manually operable knob 13 (hereinafter simply referred to as first knob 13 in this description) for regulating amplitude is fixed and also a regulating plate 15 is fixed so as to be jointly rotated with first knob 13. An actuating arm 16 is loosely fitted onto shaft 14 and is operatively connected, through a link 17, to a well-known needle bar oscillating rod 130, which is in turn connected to a needle bar supporting frame (not shown). The frame carries a needle bar 131. Due to a rotational movement of actuating arm 16 around shaft 14 said needle bar oscillating rod 130 is displaced to change the distance between a roller 132 carried thereby and the oscillating fulcrum of a well-known oscillating arm 133, resulting in a change of amplitude of lateral oscillation imparted to the needle bar 131. Said actuating arm 16 is also provided with an engagement pin 18 fixed thereto and a yoke portion **16*a* formed on one end thereof, which pin 18 is confronted with a lug 15*a* formed on said regulating plate 15. A connection lever 19 is rotatably mounted on a shaft 20 secured to auxiliary plate 12. A pin 21 fixed to said lever 19, is fitted into the yoke portion 16*a* of actuating arm 16; lever 19 is counterclockwise (in FIG. 2) biased by the action of a tension spring 22 anchored between the same and auxiliary plate 12, which in turn clockwise (in the same FIG.) biases actuating arm 16. Engagement pin 18, consequently, bears against the lug 15*a* of regulating plate 15, biasing the plate 15 together with shaft 14 and first knob 13 in the clockwise direction in the same Figure. However, the first knob 13 is so constructed as to be maintained at a desired rotated position against the biasing force by means of an engagement means just like that in a later described second manually operable knob, which brings about a prevention of further rotative movement of the actuating arm 16 because of the contacting of the engagement pin 18 against lug 15*a* of regulating plate 15. When first knob 13 is operatively rotated, therefore, regulating plate 15 and actuating arm 16 are jointly rotated to change, as above-mentioned, the distance between roller 132 carried by needle bar oscillating rod 130 and the oscillating fulcrum of oscillating arm 133, by which the amplitude of oscillation imparted to the needle bar 131 is to be changed. In this way an amplitude regulator is composed of oscillating arm 133, roller 132, link 17, actuating arm 16**, etc.

On a shaft 24 which is rotatably carried by auxiliary plate 12 are secured a second manually operable knob 23 (hereinafter simply referred to as second knob 23 in this description) and a feed regulating cam body 25 for being jointly rotated therewith. On the edge of cam body 25 is formed a cam surface **25*a* for setting a length of forward feed movement. A leaf spring 26 is secured with a screw 27 on the back of auxiliary plate 12. On the tip of leaf spring 26 thereof is fixed an engagement pin 28 which passes through auxiliary plate 12 to engage with a knurling impressed on the back of second knob 23, enabling the second knob 23 to be retained at any desired position rotated; and first knob 13 is also likewise constructed. On a bracket 29 secured to the machine frame 2 are rotatably carried a feed controlling lever 30 and a feed controlling arm 32 with a stepped screw 31, feed controlling arm 32 being fixed to feed controlling lever 30 with a screw 33 for being jointly rotatable therewith; on the tip of feed controlling arm 32 is fixed an engagement pin 34 for contacting engagement with cam surface 25*a* of feed regulating cam body 25. A feed regulating shaft 35 is rotatably carried by machine frame 2 and bracket 29, on one end of which is secured a well-known feed regulating member 36; on the other end thereof is secured a connection arm 37, which is, through rod 38, connected to feed controlling lever 30. A coil spring 39 is wound around feed regulating shaft 35 and imparts to the same rotative force in the clockwise direction in FIG. 3, which makes engagement pin 34 of feed controlling arm 32 contact with cam surface 25*a* of feed regulating cam 25. When second arm 23 is operatively rotated, feed regulating shaft 35 is, therefore, rotated through feed regulating cam body 25, feed controlling arm 32, feed controlling lever 30, rod 38, and connecting arm 37; the resulting change of set position of feed regulating member 36 renders an adjustment in the length of feed movement of a well-known feed dog 134 possible. A feed regulator is thus composed of feed regulating member 36, feed controlling lever 30, feed controlling arm 32, and feed regulating cam body 25, etc. The operative connection between feed regulating member 36 and feed dog 134** is so well-known that no description will be needed.

A manually operable lever 40 is located at the upper part of the jaw of the machine and is disposed operably from the front side of the machine, being secured on the front end of a shaft 41 rotatably carried by machine frame 2; on the rear end side of shaft 41 is secured a connection arm 42. An operating arm 43 is rotatably mounted with a stepped screw 45 on a supporting bracket 44 secured to machine frame 2, with one arm thereof being connected through a link 46 to connection arm 42. On the other arm of operating arm 43 thereof are formed an operating projection **43*a* and an aperture for fitting 43*b*. A switching arm 47 is rotatably mounted with stepped screw 45 on supporting bracket 44. On one arm of switching arm 47 is fixed a stepped shank-pin 48 having a first, a second, and a third shank portions 48*a*, 48*b*, and 48*c*. On the other arm of switching arm 47 the action of a tension spring 49 which anchors between the other arm and operating arm 43 makes second shank portion 48*b* contact the upper edge of aperture 43*b* for bringing about a united rotation of operating arm 43 and switching arm 47 all the time in that state. A switching lever 50 is in the middle part thereof rotatably supported with a stepped screw 51 on the machine frame 2. In a yoke portion 50*a* formed on one end of switching lever 50 is fitted third shank portion 48*c* of stepped sank pin 48; lever 50 is clockwise biased (in FIG. 2) by the action of a tension spring 52 anchored between the same and the machine frame, consequently resulting in biasing switching arm 47 and operating arm 43 in the counterclockwise direction in FIG. 2; however, due to a contact of one side edge of operating arm 43 against a of a resistor 98, a diode 99, switch 74** connected to a contact *b* of switch 74 and a capacitor 100; a contact *a* of switch 74 on the other side is connected through a resistor 101 and a diode 102 to the gate of second thyristor 83. To the base of a transistor 103, which constitutes a bypass circuit being parallelly connected to the series circuit comprising resistors 86 to 88, is connected respectively one terminal of each of three adjustable resistors 104 to 106 parallelly disposed with respect to one another; each terminal on the other side of these three resistors is respectively connected to interlocking switches 107 to 109 which are to be opened or closed in interlocking relationship with selector switches 91 to 93; these interlocking switches are all connected through a resistor 110 to the contact *a* of switch 74.

A series circuit consisting of a resistor 111 and a capacitor 112 is to be parallelly connected to a series circuit consisting of switch 74 which has been changed over to the side of contact *a* and capacitor 100.

A protective resistor 113 is connected between the base and emitter of transistor 103, and a resistor 114 is parallelly connected to a series circuit consisting of diode 99, switch 74, and capacitor 100. Across the junction of resistors 85 and 86 and the gate of second thyristor 83 is connected a series circuit comprising a capacitor 115, a resistor 116 and a diode 117; and across the junction of resistors 84 and 85 and the junction of capacitor 115 and resistor 116 is connected a diode 118 with polarities illustrated. Besides, across bus lines P and N are connected a capacitor 119 for erasing noise and a lamp 120. Reference numeral 121 denotes a main switch to turn on and off the power supplied to the control circuit.

Figure 6:
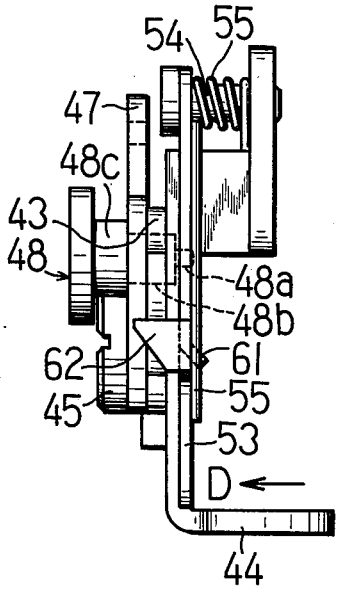
Figure 7:
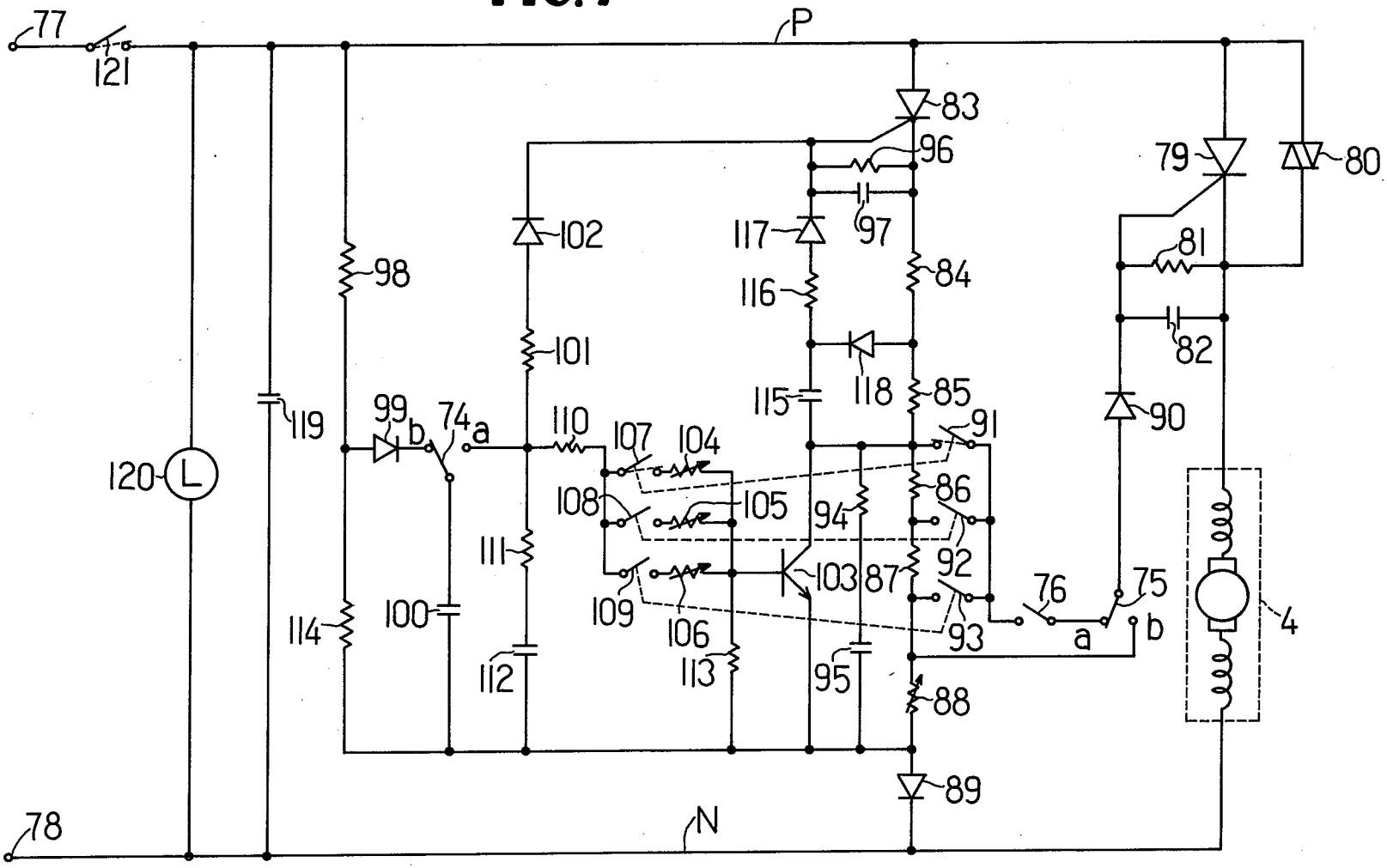

On an embodiment having the construction abovementioned, detailed working operation will be described. FIGS. 2 to 7 show the respective portion of a sewing machine whose operation is ceased by the manually operable lever 40 being placed at the stop working position $P_1$, that is to say, the releasing push button 11 shown in FIG. 1 has been depressed and selector switches 91 to 93 as well as interlocking switches 107 to 109 in FIG. 7 are all open. The position of regulating plate 15, actuating arm 16, and link 17, etc., shown with solid lines in FIG. 2 represents a state wherein the first knob 13 has been clockwise (in FIG. 1) rotated to the maximum extent and the amplitude of lateral movement of the needle bar is set at the maximum; the position of feed regulating cam body 25, feed controlling arm 32, feed controlling lever 30, etc., shown in FIG. 3 represents a state wherein the length of feed movement is set at the middle. All of these may, however, be variably set at any desired position, as stated above, by means of manual operation of the first and second knobs 13 and 23.

When the main switch 121 in FIG. 7 is closed, the lamp 120 is disposed in the machine head is lit to make a machine operator perceive the supply of power. In order to set the operating speed of the machine at any one of high, middle, and low speed, the desired one of push buttons 8, 9, and 10 for speed-setting in FIG. 1 is to be depressed. For example, if the button 8 for high speed is pressed down, it will be retained at the depressed state by means of an appropriate conventional means with a result of closing the selector switch 91 for speed-setting accompanied by closing of the interlocking switch 107.

When the manually operable lever 40 is clockwise rotated from the position $P_1$ in FIG. 2, operating arm 43 is rotated in the same direction, and the upper side edge of aperture **43*b* thereof depresses in turn the second shank portion 48*b* of stepped shank pin 48. The switching arm 47 is also rotated in the same direction, consequently, followed by a counterclockwise rotation (in Fig. 2) of switching lever 50 against the action of tension spring 52, which does sequentially result in rotation of actuating lever 63 through rod 65, then rotation of switch actuating cam body 71 through the movement of rod 69, rotating arm 68, and rod 73. When lever 40 has reached the rotated position $P_2$, actuating elements of switch 74 and 76 are respectively depressed by the switch operating cam body 71 to cause switch 74** to be switched to the side of contact *a* and switch 76 to be closed.

That manually operable lever 40 has reached the rotated-position $P_2$ can be perceived by a machine operator through a sudden change of rotation resistance that takes place therein when the first shank portion **48*a* of stepped shank pin 48 contacts the guide edge 57 of engagement arm 53 immediately after having passed around the slant edge 56 and the then arising contact sound. When the lever 40 is released at this time, the state shown in FIG. 8, wherein first shank portion 48*a* is engaged with the upper side edge of engagement slot 59, will be maintained; that is to say, the lever 40 is retained at the rotated-position $P_2$ shown in FIG. 2 against the action of tension spring 52**.

In this condition the eccentric roll 66 of actuating lever 63 has no contact with feed controlling lever 30 and the tip **63*a* of actuating lever 63 is not engaged with the tip 19*a* of connection lever 19**, either.

Due to the turning over of switch 74 to the side of contact *a*, the electric charge of capacitor 100 hitherto charged is input to the gate of second thyristor 83 through resistor 101 and diode 102, causing the same to be conductive and the capacitor 115 will be charged through resistor 84 and diode 118. On the other hand, the electric charge of capacitor 100 is input to the base of transistor 103 through resistor 110, interlocking switch 107, and resistor 104, causing the transistor 103 to be conductive. Owing to energization of second thyristor 83 the current introduced to the signal-level-setting circuit from bus line P passes scarcely during the initial stage through the series circuit containing resistors 86 to 88 and a major current makes a detour of the bypass circuit comprising transistor 103, flowing into bus line N via diode 89. As the discharge of capacitor 100 progresses the input to the base of transistor 103 decreases, resulting in the gradual decrease of current flowing through the bypass circuit; instead, the current flowing through the series circuit containing resistors 86 to 88 increases by degrees, and finally when the discharge of capacitor 100 has been nearly completed the transistor 103 becomes non-conductive, causing the bypass circuit to be cut off. A trigger signal fed by the signal level setting circuit to first thyristor 79 is too small, immediately after the switching over to contact *a* of switch 74 and the closing of switch 76, to render the thyristor 79 conductive; the signal level is, however, gradually raised to energize the same and finally to actuate the electric motor 4 by supplying power.

Figure 4:
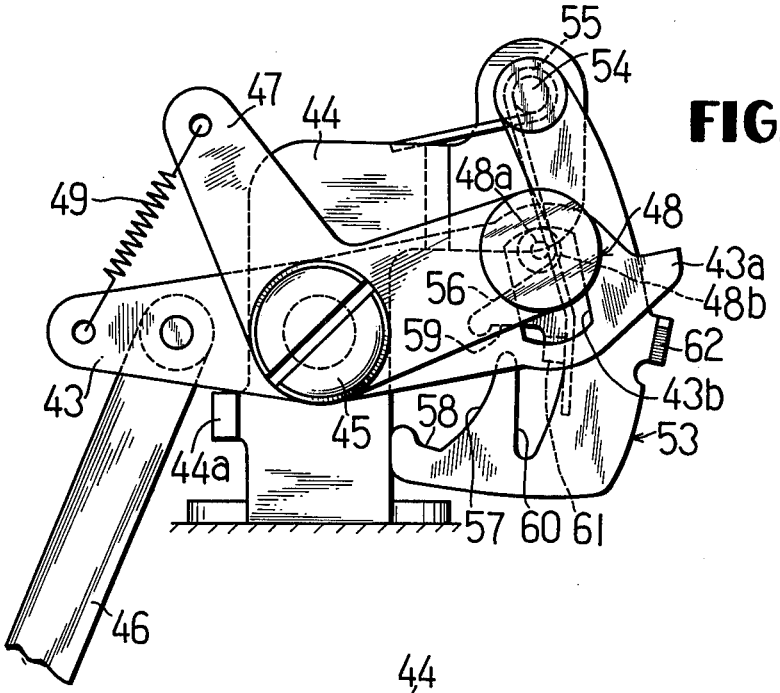
Figure 5:
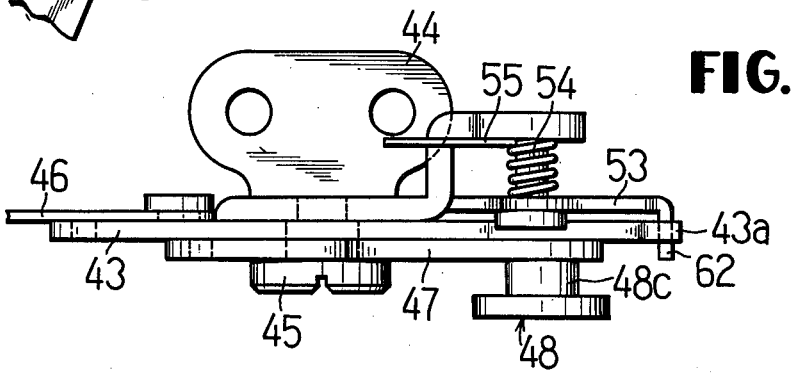

The larger the conduction angle of the thyristor becomes, the greater the rotational speed of motor 4; when transistor 103 has been non-conductive a trigger signal at a level set by the selector switch 91 that has been optionally closed beforehand, is input to thyristor 79, bringing the speed of motor 4 up to the predeterbent portion 44*a* formed on supporting bracket 44 the above-mentioned biasing is not allowed beyond the position shown in FIGS. 2 and 4. An engagement arm 53 is mounted with a fitting unit 54 on supporting bracket 44, being rotatable about the shaft 54 and also tiltable; and a coil spring 55 wound around the shaft 54 between engagement arm 53 and supporting bracket 44 is anchored at one end with supporting bracket 44, as shown in FIG. 4 and extends at the other end along engagement arm 53 to be anchored with a later described slanting portion thereof, for imparting to engagement arm 53 a clockwise rotative force in FIG. 4 as well as biasing the same in the direction of the arrow D in FIG. 6. Engagement arm 53 is, consequently, at the projecting portion of the lowermost end thereof, in abutting relationship with one edge of said supporting bracket 44 as shown in FIG. 4 to be prevented from further clockwise rotation, and is in contact with the head portion of fitting shaft 54 as shown in FIG. 6 to be normally maintained in parallel with operating arm 43 and switching arm 47, and is arranged in a manner such that one side edge thereof is in contacting engagement with first shank portion 48*a* of stepped shank pin 48.

Figure 10:
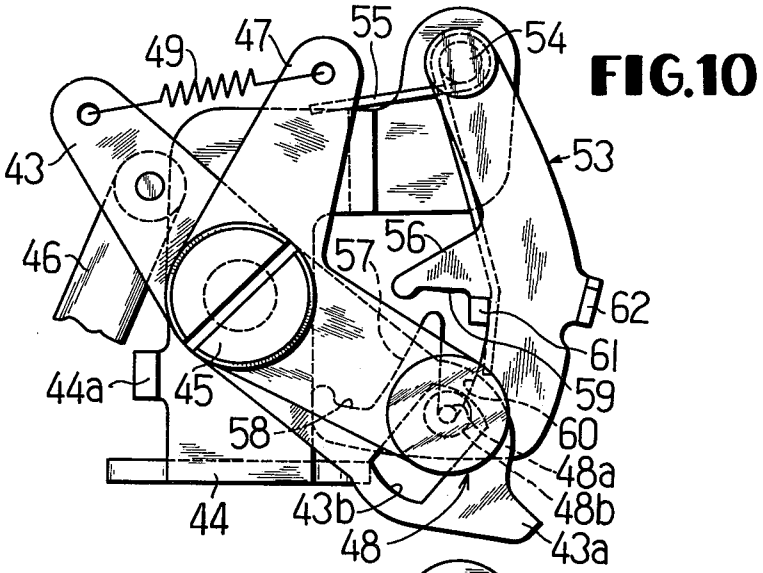

On one side of engagement arm 53 are disposed the following three edge portions: (a) a slant edge 56 for being engaged with first shank portion 48*a* of stepped shank pin 48, when switching arm 47 is clockwise rotated from the state seen in FIG. 4, in order to bias counterclockwise engagement arm 53 against the action of coil spring 55; (b) a guide edge 57 for engaging with stepped shank pin 48, which has passed around the slant edge 56, when switching arm 47 further tends to rotate in the clockwise direction; and (c) an engagement edge 58 for preventing a further rotation of switching arm 47 by, succeeding the guide edge 57, engaging with first shank portion 48*a* (refer to FIG. 9). An engagement recess or slot 59 is so formed that the outer edge thereof is positioned between slant edge 57 and guide edge 58, with the object of contacting at its upper edge first shank portion 48*a*, when switching arm 47 has been counterclockwise rotatively returned from the state shown in FIG. 9, for blocking the rotative return of switching arm 47 to the position in FIG. 4 and for allowing engagement arm 53 to rotatively return from the position shown in FIG. 9 to that in FIG. 8 by the action of the coil spring 55. Due to the engagement of first shank portion 48*a* with the inside edge of engagement slot 59, further rotation of engagement arm 63 can be blocked with a result of maintaining the state shown in FIG. 8. A guide slot 60 neighboring to engagement slot 59 allows switching arm 47 to be re-rotated from the position in FIG. 8 to that in FIG. 10; an engagement of first shank portion 48*a* with the underside edge of guide slot 60 blocks a further clockwise rotation of the switching arm 47. A slant portion 61 is a continuation of and located at the upper part of guide slot 60. The outer end of slant portion 61 is slanted, as shown in FIG. 6, in the direction away from switching arm 47 and operating arm 43. When, therefore, switching arm 47 has been counterclockwise rotatively returned from the state shown in FIG. 10, slant portion 61 is depressed by the tip of stepped shank pin 48 to force engagement arm 53 to be slanted in the reverse direction of the arrow D shown in FIG. 6 against the action of coil spring 55, and consequently to allow switching arm 47 to be rotatively returned to the position shown in FIG. 4. A bent portion 62 formed on the other side of engagement arm 53 is erected in the direction toward operating arm 43 as apparent in FIG. 6, having a slant surface on the outer end thereof, and disposed as later described capable of operative engagement with the operating projection 43*a* of operating arm 43. With the above-mentioned construction manually operable lever 40 can be optionally shifted to any of the three positions $P_1$, $P_2$, and $P_3$ shown in FIG. 2.

Referring further to FIGS. 2 and 3, an actuating lever 63 is rotatably mounted on a pivot shaft 64 which is fixed to the bracket 29, one end thereof being confronted from above with the other end 19*a* of connection lever 19 and the other end thereof being connected with the other end of the switching lever 50 through a rod 65; an eccentric roll 66 is adjustably secured with a screw 67 onto actuating lever 63. When actuating lever 63 has been counterclockwise (in FIG. 3) rotated, the periphery of eccentric roll 66 is engaged with the underside edge of feed controlling lever 30 to rotate the same in the identical direction; a rotating lever 68 is loosely and rotatably fitted onto feed regulating shaft 35 and is connected to actuating lever 63 through a rod 69. On a fitting plate 70 secured to the machine frame is rotatably mounted, with a pivot shaft 72, a switch actuating cam body 71, which is in turn connected through a rod 73 to rotating lever 68. Three switches 74, 75, and 76 are secured to fitting plate 70, being arranged side by side; each actuator thereof is engageably disposed with the underside portion of switch actuating cam body 71 and is so built as to be capable of actuation in sequence by means of a cam portion 71*a* formed on the underside.

Referring to FIG. 7 an embodiment of the electric circuit will now be explained. Bus lines P and N are derived from electric power supply terminals 77 and 78 which are connected to an alternating current source; across the bus line P and N are connected in series the electric motor 4, for example a commutator motor, etc., for driving the main shaft and a thyristor 79 for controlling the power supply to the motor. To this thyristor 79 is conected in parallel a varistor 80 for protective use; across the gate and cathode of thyristor 79 is connected a parallel circuit consisting of a resistor 81 and a capacitor 82 as a protecting means from mis-fire. Across bus lines P and N is also connected through a second thyristor 83 a signal level setting circuit for setting a trigger signal level to thyristor 79. This setting circuit is composed of (a) a series circuit consisting of a plurality of resistors 84 to 88 and a diode 89; and (b) speed-setting selector switches 91 to 93 for optionally connecting any one of each junction of resistors 85 to 88, through switches 76 and 75 as well as a diode 90, to the gate of thyristor 79; and (c) a series circuit consisting of a resistor 94 and a capacitor 95, which circuit is parallelly connected to a series circuit of said resistors 86 to 88. Between the gate and cathode of second thyristor 83 is connected a parallel circuit consisting of a resistor 96 and a capacitor 97. Selector switches 91 to 93 are respectively interlocked with the depressing operation of the above described speed-setting push button 8 to 10 (refer to FIG. 1) for closing the circuit. Switch 76 is open when manually operable lever 40 is positioned at $P_1$ shown in FIG. 2 and closed when the lever 40 is positioned at $P_2$, $P_3$ or anywhere inbetween; furthermore, switch 75 is normally connected to the contact point *a* and is changed over to the contact point *b* which is connected to a junction of resistors 87 and 88, only when lever 40 has been operatively shifted to the $P_3$ position. Across the bus lines P and N is connected, through diode 89, still another series circuit consisting mined rate of revolution. As the second thyristor 83 has been rendered conductive, the capacitor 115 is to be charged and the electric charge thereof will be input, in place of capacitor 100 whose discharge has been nearly completed, to the gate of second thyristor 83 via resistor 116 and diode 117; this thyristor is to be maintained conductive. Once the thyristor 83 is energized, the conductive state is maintained independently of running or stopping of the machine, i.e., opening and closing of the switch 76 or changing over operation of switches 74 and 75; the capacitor 115 will repeat meanwhile charging and discharging. After transistor 103 has been deenergized, the motor 4 is driven at a constant rate of revolution that has been set by means of the push button 8 for setting speed.

When the machine is run in this way, a desired sewing is performed at the amplitude and feed length preset by the first and second knobs 13 and 23. When another push button 9 or 10 is depressed, however, during the sewing operation selector switch 91 and interlocking switch 107 are opened and selector switch 92 or 93 is closed accompanied by the interlocking switch thereof 108 or 109. To the thyristor 79 is input a signal level lower than that in the above-mentioned case, which causes the motor 4 to be driven at a rate of revolution corresponding to that (middle or low) speed; transistor 103 is maintained non-conductive at this time, as capacitor 100 has been perfectly discharged.

Figure 11:
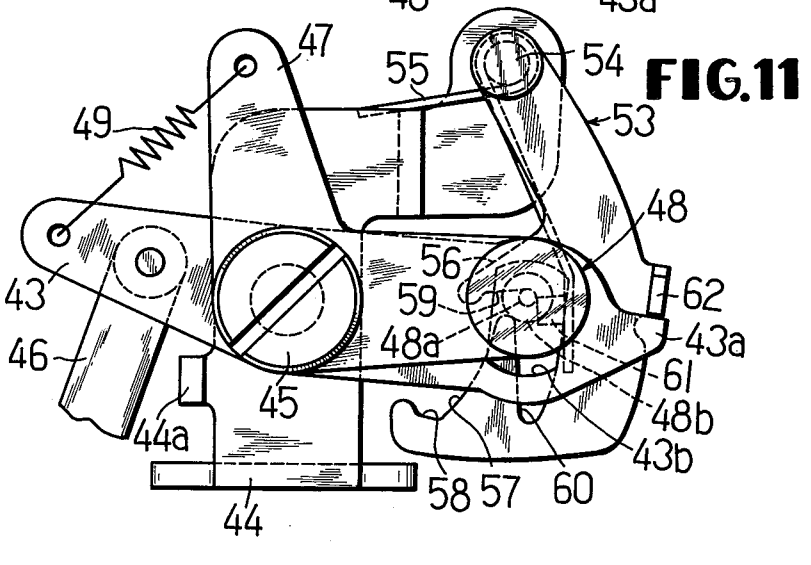

If the manually operable lever 40 is returned to the original position $P_1$ from the rotated-position $P_2$, switch 76 is released to cut off the trigger signal to first thyristor 79, bringing about an interruption of power supply to the motor 4, which in turn results in ceasing running of the machine at a random position. Furthermore, switch 74 is returned to the contact *b*, causing capacitor 100 to be charged. It is apparent from the above description that the second thyristor 83 is still maintained conductive. Manually operable lever 40 can be returned to the original position $P_1$ in a way referred to hereinafter. When the lever 40 is rotated from the state shown in FIG. 8, operating arm 43 is counterclockwise (in the same Figure) rotated independently of switching lever 47; operating lug 43*a* of operating arm 43 thereof engages with the bent portion 62 of engagement arm 53 from underneath (refer to FIG. 11) for shifting the same rearward (to the right in FIG. 6) against the action of coil spring 55. The first shank portion 48*a* of stepped shank pin 48 which has hitherto been engaged with the engagement slot 59 of engagement arm 53 is consequently released of engagement therewith to pass over the front surface portion of engagement arm 53 due to the action of tension spring 49. Thus, the lever 40 has been returned to the original position shown in FIGS. 2 and 4 and switching lever 50, actuating lever 63, switch actuating cam body 71, etc., are also returned to the position shown in FIGS. 2 and 3 to release switch 76 as mentioned above.

In making a sewing anew, when any one of push buttons 8 to 10 is depressed, with the object of setting a desired speed of the motor, to close any one of selector switches 91 to 93, and the manually operable lever 40 is rotated to the $P_2$ position, switches 74 and 76 are actuated to increase gradually the level of trigger signal to first thyristor 79 in response to the discharge of capacitor 100; the number of revolutions of motor 4 is increased by degrees just like the case wherein the conventional foot controller is gradually depressed. Once a preset rate of revolution has been reached, the motor can be driven at the constant speed.

Figure 9:
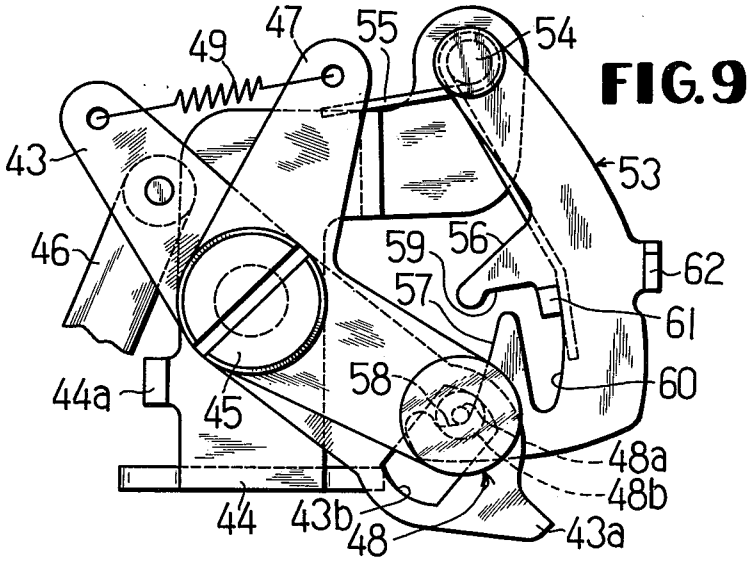

In this embodiment the lever 40 is so built as to be able also to rotate to the position $P_3$ shown in FIG. 2 wherein non-ravel seaming can be performed at a low speed; that is to say, when the lever 40 is rotated from the machine stopping position $P_1$, beyond the position $P_2$, to the position $P_3$, operating arm 43 and switching arm 47 will be shifted to the state shown in FIG. 9, causing first shank portion 48*a* of stepped shank pin 48 to engage with the engagement edge 58 of engagement arm 53; first shank portion 48*a* is to be maintained at the same position so long as the lever 40 is depressed downward from above. Due to the rotation of lever 40 to the position $P_3$ the switching lever 50 is counterclockwise in FIG. 2 rotated to the maximum extent, which in turn rotates actuating lever 63 in the counterclockwise direction in FIG. 3 to the maximum via rod 65 above mentioned. As a result, eccentric roll 66 contacts the underside edge of feed controlling lever 30 to rotate the same in the same direction, which causes the feed regulating shaft 35 to be rotated together with feed regulating member 36 against the action of coil spring 39 via rod 38 and connection arm 37 in due sequence. Consequently, the feed regulating member 36 can be changed into a state suitable for non-ravel seaming, e.g., for imparting fine forward or backward feed movement to the feed dog 134. The engagement pin 34 of feed controlling arm 32 is then moved in a direction away from the forward feed cam surface of the feed regulating cam body 25, and so the second knob 23 is rendered ineffective. The rotated position of feed regulating member 36 can also be adjusted by rotating said eccentric roll 66. On the other hand, due to the rotation of actuating lever 63 the tip 63*a* thereof depresses from above the end portion 19*a* of connection lever 19 to rotate the lever 19 to the position represented by a two-dot and chain line in FIG. 2.

Consequently, actuating arm 16 is independently of regulating plate 15 rotated from the position of solid line B to that of two-dot and chain line A to move the roll 132 of needle bar oscillating rod 130 to the coinciding position with the oscillation fulcrum of oscillating arm 133, resulting in reducing the oscillation amplitude of needle bar 131 to zero.

Furthermore, rotation of actuating lever 63, via rotation of switch actuating cam body 71 just like the above-mentioned, turns over each of switches 74, 75 and 76 in a manner stated hereinafter. Because of passing over second rotated-position $P_2$ of the lever 40, switch 76 is closed and switch 74 is once switched over to the contact *a*, and the electric charge of capacitor 100 is input to the gate of second thyristor 83. When thyristor 83 is not in a conductive state then, the same will be, therefore, conductive to start the motor 4 slowly to rotate. When the lever 40 is moved to the third rotated-position $P_3$, however, switch 74 is returned to the contact *b* followed by returning of switch 75 to the contact *b*. Even though selector switch 91 for setting high speed is in a closed state, the motor 4 is, therefore, driven at a low speed just like the case wherein selector switch 93 for setting low speed is closed. When switch 74 is turned over to the side of contact *a*, the electric charge of capacitor 112, which has been instantaneously charged due to the discharge of capacitor 100, is input to the base of transistor 103 via resistor 111, 110, and the closed interlocking switch, and the transistor is rendered conductive to actuate the bypass circuit, bringing about a so-called soft starting of the motor 4, i.e., gradual increase of the number of revolutions; thereafter, the motor 4 is driven at a preset low speed. Although thyristor 112 has a function of rendering conductive second thyristor 83, when the thyristor has not reached a conductive state due to the above-mentioned turning over of switch 74 to the side of contact *a*, once energized thyristor 83 can be maintained conductive so long as the main switch 121 is closed as above mentioned. Therefore, such function takes place only when the machine is started working. When the lever 40 is operatively shifted to the position $P_3$, as stated above, oscillation amplitude of the needle bar is reduced to zero independently of the setting state of first knob 13, and length of feed movement is also changed to a feed length suitable for non-ravel seaming (fine feed length), independently of the setting state of the second knob 23, and the motor is driven at the low speed independently of the setting state of push buttons 8, 9, and 10 for speed setting. Owing to that, non-ravel seaming can be readily performed at a low speed.

Figure 8:
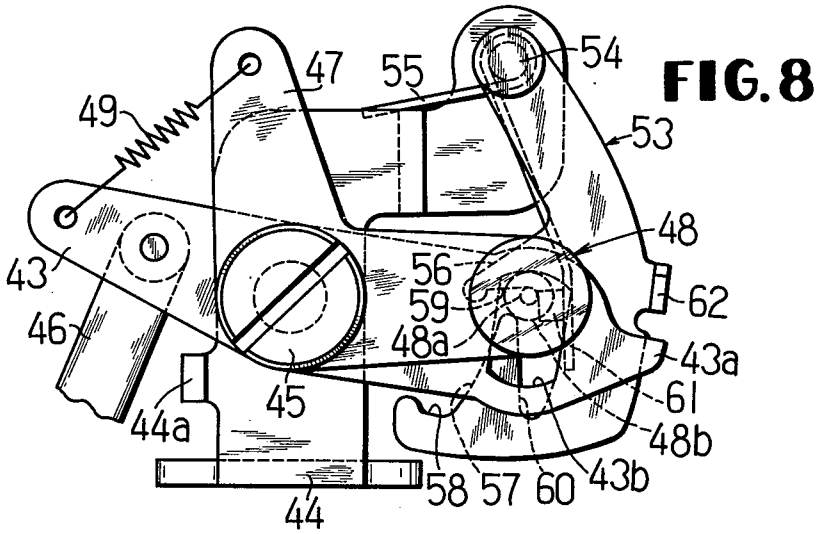

When the lever 40 is released from the depressing, after having performed a desired non-ravel seaming in the way stated above, switching lever 50 is rotated owing to the action of tension spring 52, and switching arm 47 and operating arm 43 are moved to the state shown in FIG. 8, which causes first shank portion 48*a* of stepped shank pin 48 to be engaged with engagement slot 59 of engagement arm 53 for being preserved in the state. The lever 40 is then moved to and retained at the second position $P_2$, and actuating lever 63 and switch actuating cam body 71 are also moved to a corresponding position. Switch 75 is, consequently, returned to the side of contact *a* accompanied by re-turning over of switch 74 to the side of contact *a* and the maintenance of switch 76 in a closed state. The motor 4 is started slowly, in a similar way as stated above, being gradually increased in the rate of revolution; after having reached a preset speed it is driven at a constant speed. Actuating arm 16 is returned to a preset position by first knob 13 and feed regulation member 36 is also rotated back together with feed controlling lever 30 and feed controlling arm 32, which are maintained in a state wherein engagement pin 34 is in contact with the cam surface 25*a* of feed regulating cam body 25. Therefore, a desired sewing at a preset oscillation amplitude and feed length by means of first and second knobs 13 and 23 and at a preset speed by means of push buttons 8, 9, and 10 can be performed.

Upon completion of the sewing, if the lever 40 is operatively shifted to the first point $P_1$ switch 70 will be opened and in turn power supply to the motor 4 is to be cut off, causing the machine to stop at a random position. If a non-ravel seaming is desired at the end of sewing, all that has to be done is to operatively depress the lever 40 from the position $P_2$ again to $P_3$. Operating arm 43 and switching arm 47 are consequently shifted to the position shown in FIG. 10, and actuating lever 63, switch actuating cam body 71, etc., are rotated, similarly as above-mentioned, to the position for non-ravel seaming, allowing a non-ravel seaming at a low speed. First shank portion 48*a* of steppped shank pin 48 which is disposed through switching arm 47 is in contact with the underside edge of guide slot 60 formed on engagement arm 53 to be prevented from further rotation. As a result, the lever 40 assumes a completely identical position as when first shank portion 48*a* contacts the engagement edge 58 of engagement arm 53 (FIG. 9).

When the lever 40, after having finished a desired non-ravel seaming, is released of depression, switching arm 47 is rotated by the action of tension spring 52, and first shank portion 48*a* of stepped shank pin 48 contacts the slant portion 61 of engagement arm 53 to slant or incline the engagement arm 53 against the action of coil spring 55. The stepped shank pin 48 can be moved, therefore, without being engaged with engagement arm 53, to return to the position shown in FIG. 4. The lever 40 is, therefore, returned to the first position $P_1$ passing over the second position $P_2$, to render switch 76 released and in turn the machine is stopped at a random position. Since the lever 40 passes over the second position $P_2$, the change-over switch 75 is turned over to the contact a side, with the switch 76 being in a closed condition; if selector switch 91 is in a closed state, motor 4 tends to be instanteneously rotated at a high speed; but as switch 74 which has once been changed to the contact *b* during the above-mentioned non-ravel seaming is turned over to the side of contact of *a*, transistor 103 is energized to actuate, with the aid of capacitor 100, the bypass circuit, which maintains motor 4 to be driven at a low speed. Afterwards the switch 76 is released to break the power supply.

As is apparent from the above description, when lever 40 is depressed from the first point $P_1$, passing over the second position $P_2$, to the third position $P_3$, non-ravel seaming at the starting stage of sewing can be performed at a low speed, and when the lever 40 is released of depression it is automatically returned to the second position $P_2$ to be maintained there for performing normal sewing (a desired seaming); and when the lever 40 is depressed again to be moved to the third position $P_3$, non-ravel seaming in the final sewing stage can be performed at a low speed; when the depression of the lever 40 is released again, it is returned to the first position $P_1$, passing over the second position $P_2$, to stop the machine working. The lever 40 is constructed like this and can be operated in accordance with a series of a program. Operating arm 43, switching arm 47, engagement arm 53, etc., compose the program means for manually operable lever 40. If the non-ravel seaming at the initial stage of sewing is required to be omitted, it is only necessary to operatively rotate the lever 40 from the first position $P_1$ to a position beyond the second position $P_2$ and to release it immediately before reaching the third position $P_3$; then the lever 40 will be retained at the second position $P_2$. If the non-ravel seaming at the final stage of sewing is desired to be omitted, forcibly rotating back the lever 40 from the second position $P_2$ toward the first position $P_1$ is enough. Then, operating arm 43 is, because of the presence of fitting aperture 43*b*, rotated independently of switching arm 47; cooperative action between the actuating lug 43*a* of operating arm 43 and the bent portion 62 of engagement arm 53 renders ineffective the engagement function of switching arm 47 with engagement arm 53 for returning the lever 40 to the first position $P_1$. Actuating lug 43*a*, bent portion 62, etc., compose the releasing means for the program means.

This embodiment, as described in greater detail above, is aimed at realization of the present invention in a non-ravel seaming mechanism incorporated into a so-called built-in controller type electric sewing machine provided with push buttons 8, 9, and 10 operable from outside of the machine frame, capable of selecting and setting the motor speed beforehand by speed-setting means such as selector switches 91, 92, and 93, allowing the control of motor driving by operation of manually operable lever 40, and having such a construction as to be run at a preset motor speed after the machine is started. The machine is constructed such that (a) the manually operable lever 40 can be shifted in order, in accordance with the action of program means, first position for stopping machine working, second position for working machine, and third position for non-ravel seaming; (b) when the lever 40 is rotated to the third position, operating conditions of the amplitude regulator and the feed regulator can be changed into those suitable for non-ravel seaming independently of setting conditions of first and second manually operable knobs 13 and 23; (c) motor driving at a low speed, independently of the revolution speed set by the speed-setting means, is possible; (d) starting and stopping as well as non-ravel seaming at the initial stage and final stage of sewing can be controlled readily and exactly by means of programming; (e) non-ravel seaming process not only can be performed by operators without feeling cumbersome but also can be performed without fear of producing any excess or deficiency as it is operable at a low speed; and (f) lever 40 can be on occasion operated independently of the program, from second position to first position directly, which permits the omission of non-ravel seaming properly and does not hinder stopping the machine working in the course of sewing.

In this embodiment, oscillation amplitude of needle bar for non-ravel seaming is set to zero accompanied by adjustment or control of feed length. An arrangement wherein either of the two may be controlled, if necessary, is also effective in practice. As stated, for example, in U.S. Pat. 3,037,471, [(corresponding to DP No. 1,073,284; BP No. 875,546)] setting to zero of the oscillation amplitude of the needle bar only is of great practical effect. In straight sewing machines, only controlling of work feed length or direction suitable for non-ravel seaming is effective.

Figure 12:
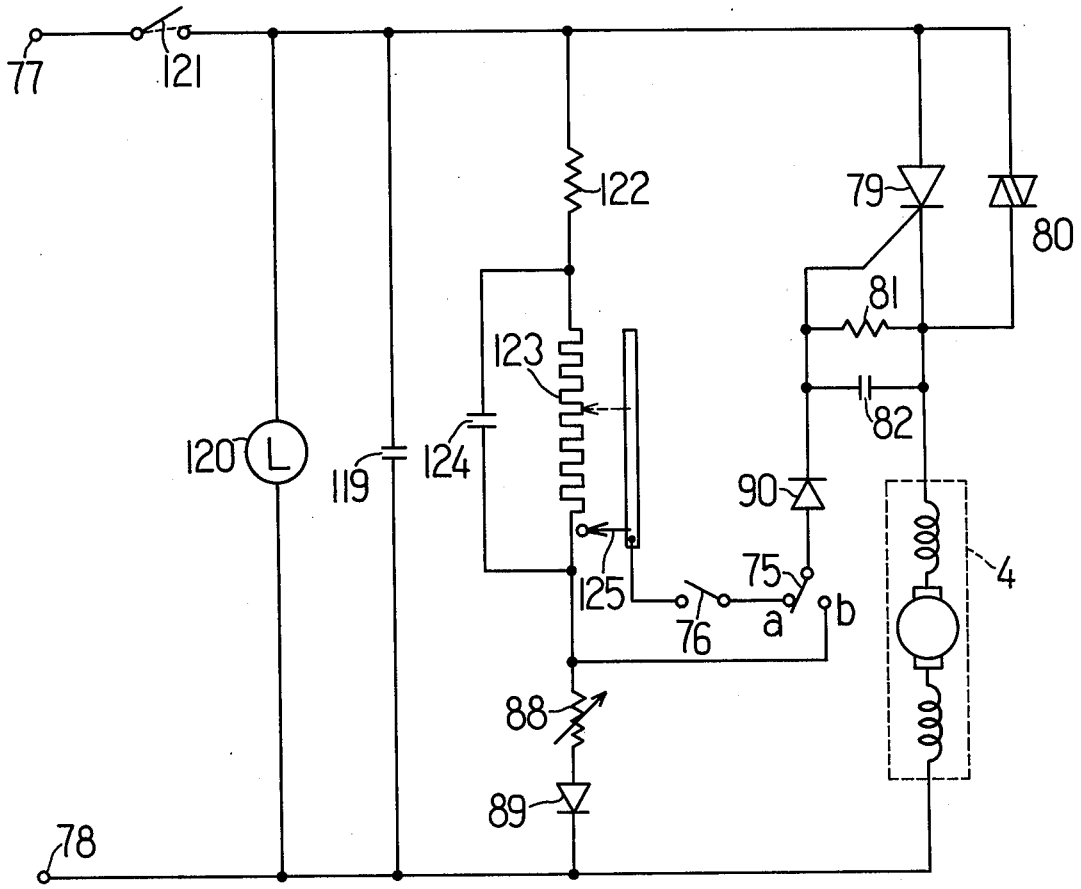
FIG. 12 is a chart of the electric circuit similar to FIG. 7 for illustrating the second embodiment of a sewing machine wherein a foot-controller is incorporated.

The present invention can be applied not only to so-called built-in controller type sewing machines but also to conventional sewing machines provided with a foot controller; an electric circuit for this case is shown in FIG. 12; all portions except electric circuit may be almost identical with the above mentioned embodiment. In FIG. 12, between bus lines P and N are connected in series protective resistor 122, variable resistor 123, resistor for setting low speed 88, and diode 89; besides, a capacitor for shifting the phase 124 is connected in parallel with the variable resistor 123; and a movable tap 125 of variable resistor 123 is connected to the gate of thyristor 79 via a two-way switch 76, a turn-over switch 75, and a diode 90; the tap 125 is located in a stationary position away from the variable resistor 123 so long as depression of the machine controller is released. When the controller is depressed the movable tap 125 will be connected to the variable resistor 123 and shifted upwards in the Figure in response to the degree of the depression; a trigger signal set in response to the shifting of the tap 125 is input to the gate of thyristor 79, which enables the electric motor 4 to be controlled in the speed. Other circuit elements are identical with those in the above-mentioned embodiment, so that they are given the same reference numerals, with the description thereof being omitted.

In such a machine as that having a foot controller, when the main switch 121 is closed and the manually operable lever 40 is shifted to the machine working position $P_2$, with the switch 76 being closed, the machine driving speed can be freely controlled, in a completely similar way as the conventional, by means of depressing operation of the controller. If the lever 40 is operated in a similar way as in the above first embodiment, non-ravel seaming can be performed in accordance with the program; that is, when the lever 40 is located at $P_1$, switch 76 is open, and mere depressing operation on the controller can not actuate the electric motor 4. If the lever 40 is, passing over the second position $P_2$, shifted to the third position $P_3$ for non-ravel seaming, switch 75 will be turned over to the side of contact *b*, which drives the motor 4 at a speed set by resistor 88 independently of the depression of the controller and allows the performance of non-ravel seaming at a low speed. When the controller is depressed after the lever 40 has been released of depression to be returned to the position $P_2$, a desired seaming at a desired driving speed can be performed, as switch 75 has already been returned to the side of contact *a*. If the lever 40 is depressed again to be shifted to the third position $P_3$, non-ravel seaming at a final stage of sewing can be performed independently of the state of controller depression. When afterwards the lever 40 is released of depression it will be instantaneously returned from the position $P_3$, passing over the second position $P_2$, to the first position $P_1$. Therefore, switch 76 is opened to stop the machine even if the controller is in a depressed state.

The device in the second embodiment is extremely effective for unskilled operators; that is, non-ravel seaming at the initial and final stage of sewing can be performed at a low speed independently of the controller operation. However, after the performance of non-ravel seaming at the beginning of sewing, the controller is automatically returned effective; and after the performance of non-ravel seaming at the termination of sewing, the machine is automatically stopped.

Figure 13:
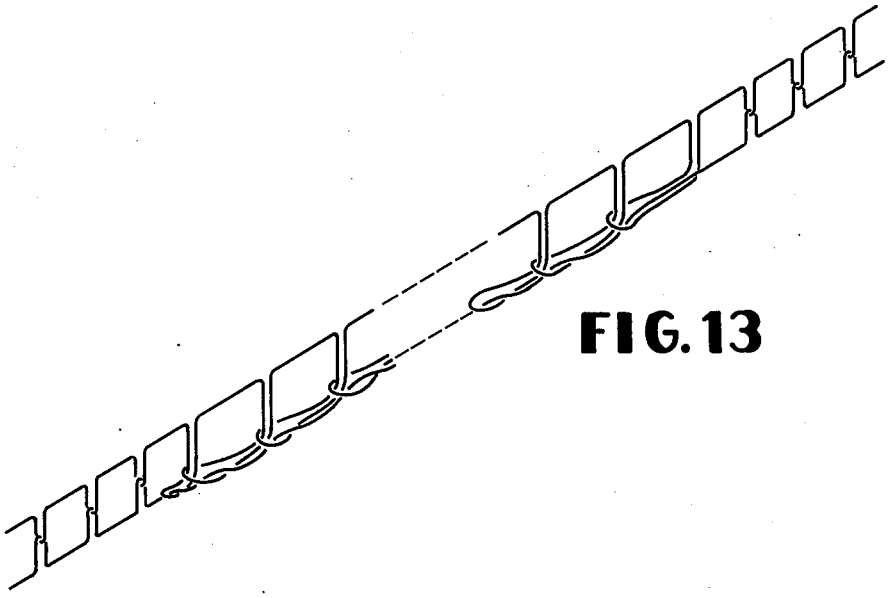
FIG. 13 is a view illustrating the stich(es) for explaining the third embodiment which has materialized the change-over between lock-stitching and chain-stitching.

The present invention is, furthermore, to be realized in still another sewing control. It is, for example, feasible to apply this invention to the change-over between lock-stitching and chain-stitching. In this case, provided that the machine is so constructed as to permit straight chain stitching to be performed when the lever 40 is shifted to the position $P_2$ and straight lock-stitching to be performed when the lever 40 is shifted to the position $P_3$, non-ravel seaming in the straight lock-stitching before and after the formation of chain-stitches can be performed, as shown in FIG. 13, and ravel prevention in the chain stitches can also be performed.

It will be obvious to those skilled in the art that various changes may be made without departing from the scope of the invention and the invention is not to be considered limited to what is shown in the drawing and described in the specification.

What is claimed is:

1. A sewing machine, comprising:

a frame;

a main shaft rotatably mounted on said frame;

an electric motor for driving said main shaft;

a motor driving circuit for supplying electrical power to said electric motor;

stitch-forming instrumentalities mounted on said frame;

at least one regulator for influencing the operation of said stitch-forming instrumentalities;

a manual knob operatively connected with each of said at least one regulator for optionally setting said regulator in a desired condition;

a single manually operable member, movably mounted on said frame and operatively connected with said motor driving circuit, for actuating said motor driving circuit to control running and stopping of the machine, said single member being movable among first, second and third positions;

stopping means for disengaging said motor driving circuit when said single member is in the first position; and running means for actuating said motor driving circuit for running of the machine when said single member is in the second or third position, said running means including first connecting means for causing the machine to be run under the optionally set conditions of said regulator, as set by said manual knob, when said single member is in the second position, and second connecting means for changing the condition of said regulator from said condition optionally set by said manual knob to a predetermined condition set independently of and without interference with the operation of said manual knob, when said single member is in the third position, whereby any one of the three operations of 1) the stopping of the machine, 2) the running of the machine under the optionally set condition of said regulator, and 3) the running of the machine under the predetermined condition of said regulator is selectively performed according to the moving of said single manually operable member into one of three different positions.

2. A sewing machine according to claim 1, further comprising:

speed-setting means connected to said motor driving circuit and providing a plurality of different operative conditions for setting the speed of said motor; and manual means operatively interconnected to said speed-setting means for selecting one of said operative conditions to optionally set the speed of said motor;

wherein second said connecting means includes a linkage connecting said speed-setting means with said single manually operable member for changing the speed of said motor from said optionally set speed to a predetermined speed set independently of and without interference with said manual means, upon the shifting of said single member to the third position, whereby at the second position of said single member the machine is run at a speed of said motor optionally set by said manual means under an optionally set condition of said regulator, and at the third position of said single member the machine is run at predetermined speed of said motor under the predetermined condition of said regulator.

3. A sewing machine according to claim 1, wherein the second position of the single manually operable member exists between the first and the third positons thereof, and further comprising:

urging means for biasing said single member to the first position; and program means operatively associated with said single member for permitting the moving thereof among the three positions in a programmed sequence, said program means including holding means for holding said single member in the second position against the action of said urging means when said single member has been moved directly from said first position to the third position, through the second position, and subsequently has been released from the third position, and actuating means for returning said single member directly to the first position when said single member has been moved from a position of having been held in the second position to the third position and subsequently has been released from the third position.

4. A sewing machine according to claim 3, further comprising:

means for releasing the action of said holding means upon the direct shifting of said single member to the first position from the second position in which said single member has been held by said holding means.

5. A sewing machine, comprising:

a frame;

a main shaft rotatably mounted on said frame;

an electric motor for driving said main shaft;

a motor driving circuit for supplying electrical power to said electric motor;

speed-setting means connected to said circuit for setting the speed of said motor and including a plurality of selector switches;

manual means including a plurality of push buttons corresponding in number to said selector switches, said push buttons being respectively connected to said selector switches for optionally pre-setting the speed of said motor;

a single manually operable member, movably mounted on said frame and operatively connected with said motor driving circuit, for actuating said motor driving circuit to control running and stopping of the machine, said single member being movable among first, second and third positions;

stopping means for disengaging said motor driving circuit when said single member is in the first position; and running means for actuating said motor driving circuit for running of the machine when said single member is in the second or third position, said running means including first connecting means for causing the machine to be run under the optionally set condition of said speed-setting means, as set by said manual means, when said single member is in the second position, and second connecting means for changing the condition of of said speed-setting means from the condition optionally set by said manual means to a predetermined low-speed condition set independently of and without interference with the operation of said manual means, when said single member is in the third position, whereby any one of the three operations of 1) stopping of the machine, 2) the running of the machine at the speed of said motor optionally set by said manual means, and 3) the running of the machine at the predetermined low speed of said motor by means of said connecting means, is selectively performed according to the moving of said single manually operable member into one of three different positions.

6. A sewing machine, comprising:

a frame;

a needle bar carried by said frame for lateral oscillation and for endwise reciprocation;

a feed dog movably mounted in cooperation with said needle bar;

a main shaft rotatably mounted on said frame for actuating said needle bar and said feed dog;

an electric motor for driving said main shaft;

a motor driving circuit for supplying electrical power to said electric motor;

an amplitude regulator for regulating the amplitude of lateral oscillation imparted to said needle bar;

a first manual knob operatively connected with said amplitude regulator for optionally setting said amplitude regulator in a desired condition;

a feed regulator for regulating the length and direction of feed movement of said feed dog;

a second manual knob operatively connected with said feed regulator for optionally setting said feed regulator in a desired condition;

a single manually operable member movably mounted on said frame and operatively connected with said motor driving circuit, for actuating said motor driving circuit to control running and stopping of the machine, said single member being movable among first, second and third positions;

stopping means for disengaging said motor driving circuit when said single member is in the first position; and running means for actuating said motor driving circuit for running the machine when said single member is in the second or third position, said running means including first connecting means for causing the machine to be run under the optionally set conditions of said amplitude and feed regulators, as set by said first and second manual knobs, when said single member is in the second position, and second connecting means for changing the condition of of said amplitude and feed regulators from said conditions optionally set by said first and second manual knobs to predetermined conditions set independently of and without interference with the operation of said first and second manual knobs, when said single member is in the third position, whereby any one of the three operations of 1) the stopping of the machine, 2) zigzag stitching with the amplitude and feed length optionally set by said first and second manual knobs, and 3) straight stitching with fine feed length, is selectively performed according to the moving of said single manually operable member into one of three different conditions.

7. A sewing machine according to claim 6, further comprising:

speed-setting means connected to said motor-driving circuit for selecting the speed of said motor and including a plurality of selector switches; and a plurality of push buttons corresponding in number to said selector switches, said push buttons being mounted on the outside of said frame and being operatively connected to said selector switches, respectively, for optionally presetting the speed of said motor;

wherein second said connecting means includes a linkage means connecting said single member with said speed-setting means for changing the speed of said motor from said speed optionally set by said push buttons to a predetermined low speed set independently of and without interference with said push buttons, when said single member is in the third position, whereby the straight stitching with the fine feed length is performed at low speed upon the moving of said single member into the third position.

8. A sewing machine, comprising:

a frame;

a needle bar carried by said frame for lateral oscillation and for endwise reciprocation;

a main shaft rotatably mounted on said frame for actuating said needle bar;

an electric motor for driving said main shaft;

a motor driving circuit for supplying electrical power to said electric motor;

an amplitude regulator for regulating the amplitude of lateral oscillation imparted to said needle bar;

a first manual knob operatively connected with said amplitude regulator for optionally setting said amplitude regulator in a desired condition;

a single manually operable member movably mounted on said frame and operatively connected with said motor driving circuit, for actuating said motor driving circuit to control running and stopping of the machine, said single member being movable among first, second and third positions;

program means operatively associated with said single member for permitting moving thereof among the three positions in a programmed sequence;

urging means for biasing said single member to the first position;

said program means including holding means for holding said single member in the second position against the action of said urging means when said single member has been moved directly from said first position to the third position, through the second position, and subsequently has been released from the third position, and actuating means for returning said single member directly to the first position when said single member has been moved from a position of having been held in the second position to the third position and subsequently has been released from the third position;

stopping means for disengaging said motor driving circuit when said single member is in the first position; and running means for actuating said motor driving circuit for running the machine when said single member is in the second or third position, said running means including first connecting means for causing the machine to be run under the optionally set conditions of said amplitude regulator, as set by said first manual knob, when said single member is in the second position, and second connecting means for changing the condition of of said amplitude regulator from the condition optionally set by said first manual knob to a condition for non-oscillation of said needle bar set independently of and without interference with the operation of said first manual knob, when said single member is in the third position, whereby any one of the three operations of 1) the stopping of the machine, 2) zigzag stitching with the amplitude optionally set by said first manual knob, and 3) straight stitching, is selectively performed according to the shifting of said single manually operable member into one of three different conditions.

9. A sewing machine according to claim 8, further comprising:

a feed dog movably mounted on said frame and actuated by said main shaft in cooperation with said needle bar;

a feed regulator for regulating the length and direction of feed movement of said feed dog; and a second manual knob operatively connected with said feed regulator for optionally setting said feed regulator in a desired condition;

wherein second said connecting means includes linkage means for connecting said single member with said feed regulator for changing the condition of said feed regulator from said condition optionally set by said second manual knob to a predetermined condition for a fine feed movement of said feed dog set independently of and without interference with the operation of said second manual knob, when said single member is in the third position, whereby at the second position of said single member, zigzag stitching with the amplitude and the feed length optionally set by said first and second manual knobs, and at the third position of the single member straight stitching with the fine feed length are selectively performed.

10. A sewing machine according to claim 9, further comprising:

speed-setting means connected to said motor driving circuit for selecting the speed of said motor and including a plurality of selector switches; and a plurality of push buttons corresponding in number to said selector switches, said push buttons being mounted on the outside of said frame and being operatively connected to said selector switches, respectively, for optionally presetting the speed of said motor;

wherein second said connecting means includes a further linkage means connecting said single member with said speed-setting means for changing the speed of said motor from said speed optionally set by said push buttons to a predetermined low speed set independently of and without interference with said push buttons, when said single member is in the third position, whereby at the second position of said single member zigzag stitching at the optionally pre-set speed, and at the third position of said single member straight stitching at the predetermined low speed are selectively performed.

11. A sewing machine, comprising:

a frame;

a main shaft rotatably mounted on said frame;

an electric motor for driving said main shaft;

a motor driving circuit for supplying electrical power to said electric motor;

stitch-forming instrumentalities mounted on said frame;

at least one regulator for influencing the operation of said stitch-forming instrumentalities;

a manual knob operatively connected with said regulator for optionally setting said regulator in a desired condition;

a single manually operable member shiftably mounted on said frame and operatively connected with said motor driving circuit for actuating said motor driving circuit to control running and stopping of the machine;

means for positioning said single manually operable member selectively in one of three different positions, the first position for stopping the machine, and the second and the third positions both for running the machine; and means for operatively connecting said single manually operable member with said regulator for changing the condition of said regulator from said optionally set condition to a predetermined condition set independently of and without interference with the operation of said manual knob, upon the shifting of said single manually operable member into the third position, whereby any one of the following three operations, i.e., the stopping of the machine, the running of the machine under the optionally set condition of said regulator, and the running of the machine under the predetermined condition of said regulator, is selectively performed according to the shifting of said single manually operable member into one of three different position.

12. A sewing machine according to claim 11, wherein the second position of the single manually operable member exists between the first and the third position thereof, and further comprising:

urging means for biasing said single member to the first position; and program means operatively associated with said single member for permitting the moving thereof among the three positions in a programmed sequence, said program means including holding means for holding said single member in the second position against the action of said urging means when said single member has been moved directly from said first position to the third position, through the second position, and subsequently has been released from the third position, and actuating means for returning said single member directly to the first position when said single memeber has been moved from a position of having been held in the second position to the third position and subsequently has been released from the third position.

13. A sewing machine, comprising:

a frame;

a main shaft rotatably mounted on said frame;

an electric motor for driving said main shaft;

a motor driving circuit for supplying electrical power to said electric motor;

speed-setting means connected to said circuit for setting the speed of said motor and including a plurality of selector switches;

manual means including a plurality of push buttons corresponding in number to said selector switches, said push buttons being respectively connected to said selector switches for optionally pre-setting the speed of said motor;

a single manually operable member shiftably mounted on said frame and operatively connected with said motor driving circuit for actuating said motor driving circuit to control running and stopping of the machine;

means for positioning said single manually operable member selectively in each one of three different positions, the first position for stopping the machine, the second position for running the machine at the pre-set speed of said motor, and the third position for running the machine at another speed of said motor; and means for operatively connecting said single manually operable member with said speed-setting means for changing the speed of the motor from said optionally pre-set speed to a predetermined low speed set independently of and without interference with said manual means, upon the shifting of said operable member into the third position, whereby any one of the following three operations, i.e., the stopping of the machine, the running of the machine at the optionally pre-set speed of the motor, and the running of the machine at the predetermine low speed of the motor is selectively performed according to the shifting of the single manually operable member into one of the three different positions.

14. A sewing machine, comprising:

a frame;

a needle bar carried by said frame for lateral oscillation and for endwise reciprocation;

a feed dog movably mounted in cooperation with said needle bar;

a main shaft rotatably mounted on said frame for actuating said needle bar and said feed dog;

an electric motor for driving said main shaft;

a motor driving circuit for supplying electrical power to said electric motor;

an amplitude regulator for regulating the amplitude of lateral oscillation imparted to said needle bar;

a first manual knob operatively connected with said amplitude regulator for optionally setting said amplitude regulator in a desired condition;

a feed regulator for regulating the length and direction of feed movement of said feed dog;

a second manual knob operatively connected with said feed regulator for optionally setting said feed regulator in a desired condition;

a single manually operable member shiftably mounted on said frame and operatively connected with said motor driving circuit, for actuating said motor driving circuit to control running and stopping of the machine;

means for positioning said single manually operable member selectively in each one of three different positions, the first position providing the stopping of the machine, and the second and third positions providing the running of the machine; and means for operatively connecting said single manually operable member with said amplitude and feed regulators for changing each condition of the regulators from said each optionally set condition to a condition for non-oscillation of said needle bar and to a condition for a fine feed movement of said feed dog, respectively, independently of and without interference with said first and second manual knobs upon the shifting of said single manually operable member into the third position, whereby zigzag stitching with the amplitude and feed length optionally set by the manual knobs, straight stitching with the fine feed length, and the stopping of the sewing operation are selectively performed according to the shifting of said single manually operable member into one of said three different positions.

15. A sewing machine, comprising:

a frame;

a needle bar carried by said frame for lateral oscillation and for endwise reciprocation;

a main shaft rotatably mounted on said frame for actuating said needle bar;

an electric motor for driving said main shaft;

a motor driving circuit for supplying electrical power to said electric motor;

an amplitude regulator for regulating the amplitude of lateral oscillation imparted to said needle bar;

a first knob operatively connected with said amplitude regulator for optionally setting said amplitude regulator in a desired condition;

a single manually operable member, shiftably mounted on said frame and operatively connected with said motor driving circuit, for actuating said motor driving circuit to control running and stopping of the machine;

program means operatively associated wih said single manually operable member and effective for positioning the single manually operable member selectively in each one of three different positions and for shifting the single manually operable member among the three positions in a programmed sequence, the first position providing the stopping of the machine the second position providing the running of the machine under the optionally set condition of said amplitude regulator, and the third position providing the running of the machine under another condition of said amplitude regulator;

urging means for biasing said single manually operable member to the first position;

said program means including holding means for holding said single member in the second position against the action of said urging means when said single member has been moved directly from said first position to the third position, through the second position, and subsequently has been released from the third position, and actuating means for returning said single member directly to the first position when said single member has been moved from a position of having been held in the second position to the third position and subsequently has been released from the third position, means for operatively connecting said single manually operable member with said amplitude regulator for changing the condition of said amplitude regulator from said optionally set condition to a condition for non-oscillation of said needle bar independently of and without interference with said manual knob upon the shifting of said single manually operable member into the third position, whereby zigzag stitching with the amplitude optionally set by the manual knob, straight stitching, and the stop of the sewing operation are performed according to the shifting of said single manually operable member among the three positions under the operation of said program means.

* * * * *